US006073726A

United States Patent [19]

McCrystal

[11] Patent Number: 6,073,726

[45] Date of Patent: *Jun. 13, 2000

[54] ADJUSTABLE STEP LADDER

[76] Inventor: James D. McCrystal, 32970 Winnepeg Pl., Lake Elsinore, Calif. 92530

[ * ] Notice: This patent issued on a continued prosecution application filed under 37 CFR 1.53(d), and is subject to the twenty year patent term provisions of 35 U.S.C. 154(a)(2).

[21] Appl. No.: 09/192,466

[22] Filed: Nov. 16, 1998

[51] Int. Cl.[7] ..... E06C 1/00; E06C 7/00

[52] U.S. Cl. ..... 182/195; 182/204

[58] Field of Search ..... 182/204, 195, 182/200, 201, 166, 167, 228.1–228.6

[56] References Cited

U.S. PATENT DOCUMENTS 4,082,162 4/1978 Diez ..... 182/166

4,671,383 6/1987 Huang ..... 182/204

5,305,851 4/1994 Katson et al. ..... 182/204

*Primary Examiner*—Daniel P. Stodola

*Assistant Examiner*—Hugh B. Thompson

*Attorney, Agent, or Firm*—Edgar W. Averill, Jr.

[57] ABSTRACT

An adjustable step ladder having four fixed side rails which are wider apart at the bottom than at the top. The step ladder has a conventional series of steps along one side. At the bottom of each of the legs an adjustable leg is located so that the ladder can be positioned in a horizontal manner no matter how irregular the terrain upon which it stands. One or more adjustable steps are affixable to the extending legs and the adjustable steps are telescoping so that they may be made wider nearer the bottom. The result is a completely adjustable ladder which is stable because it is wider at the bottom and which may have steps which are level even though the length of the legs are uneven.

8 Claims, 5 Drawing Sheets

Fig. 1
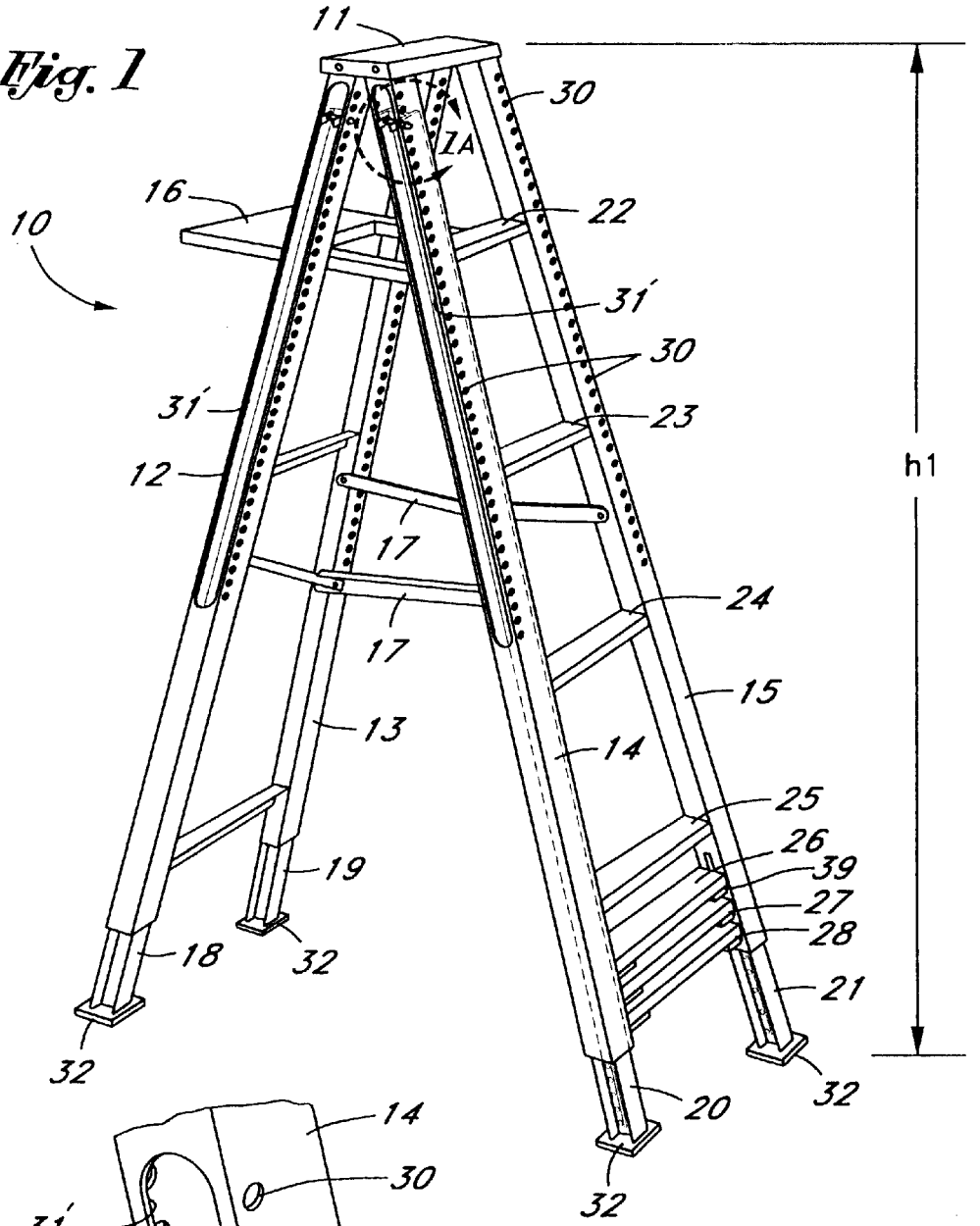
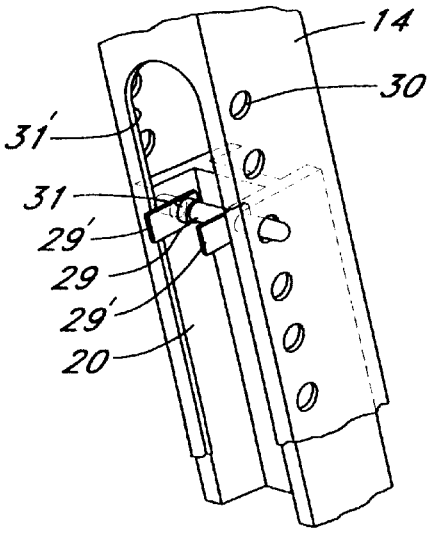
Fig. 1A
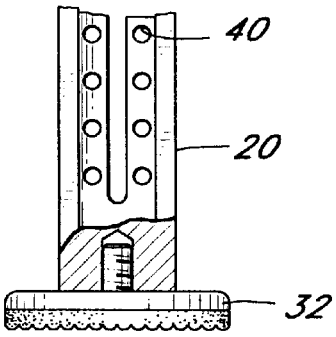
Fig. 2

11
30
16
22
10
23
31
24
17
h2
25
39
6
26
19
27
18
21
28
20
6

ADJUSTABLE STEP LADDER

BACKGROUND OF THE INVENTION

The field of the invention is ladders and the invention relates more particularly to step ladders. Step ladders are very widely used for numerous tasks such as painting and repair. Many times the ladder must be placed on a non-horizontal surface. Often workmen will place blocks under one leg which results in a very obvious safety hazard. Other times they will use the step ladder at a slight angle which is also a safety hazard. This problem has been approached over the years in many different ways. A ladder having a telescoping portion at the bottom of one of its legs is shown in U.S. Pat. No. 310,218. A different style of adjustable step ladder is shown in U.S. Pat. No. 1,169,700 where a racheting adjustment is used for the legs and a rung is provided which may be individually attached as desired.

The Diez U.S. Pat. No. 4,082,162 shows a step ladder designed for use on a flight of stairs. The Studer U.S. Pat. No. 5,074,378 shows a ladder with extendable legs. The Friedel, Jr. U.S. Pat. No. 5,265,698 shows a self leveling ladder which has extendable leg members.

None of these designs show a step ladder with a wide base and adjustable steps.

BRIEF SUMMARY OF THE INVENTION

It is an object of the present invention to provide a stable step ladder having independently adjustable leg extensions and to which steps may be affixed at a desired level.

The present invention is for an adjustable step ladder of the type having a head step, four fixed side rails affixed to the head step, two of which are step supporting rails and the other two of which are weight supporting rails. A plurality of fixed steps are positioned between the two step supporting fixed side rails and all four steps are angled so that they are further if separated from each other at the bottom than at the top. The step ladder of the present invention has individually extending legs and one or more telescoping steps are affixable to the legs which extend from the step supporting rails. Preferably there are three adjustable steps to provide a wide range of adjustability. The steps are held to the adjustable legs by a pair of pins and guided by a center pin riding in a slot of the adjustable legs.

BRIEF DESCRIPTION OF THE DRAWINGS

FIG. 1 is a perspective view of the adjustable step ladder of the present invention.

FIG. 1*a* is an enlarged view taken along lines 1*a*—1*a* of FIG. 1.

FIG. 2 is an enlarged view of an adjustable shoe at the base of one of the rails of the step ladder of FIG. 1.

DESCRIPTION OF THE PREFERRED EMBODIMENTS

Figure 3:
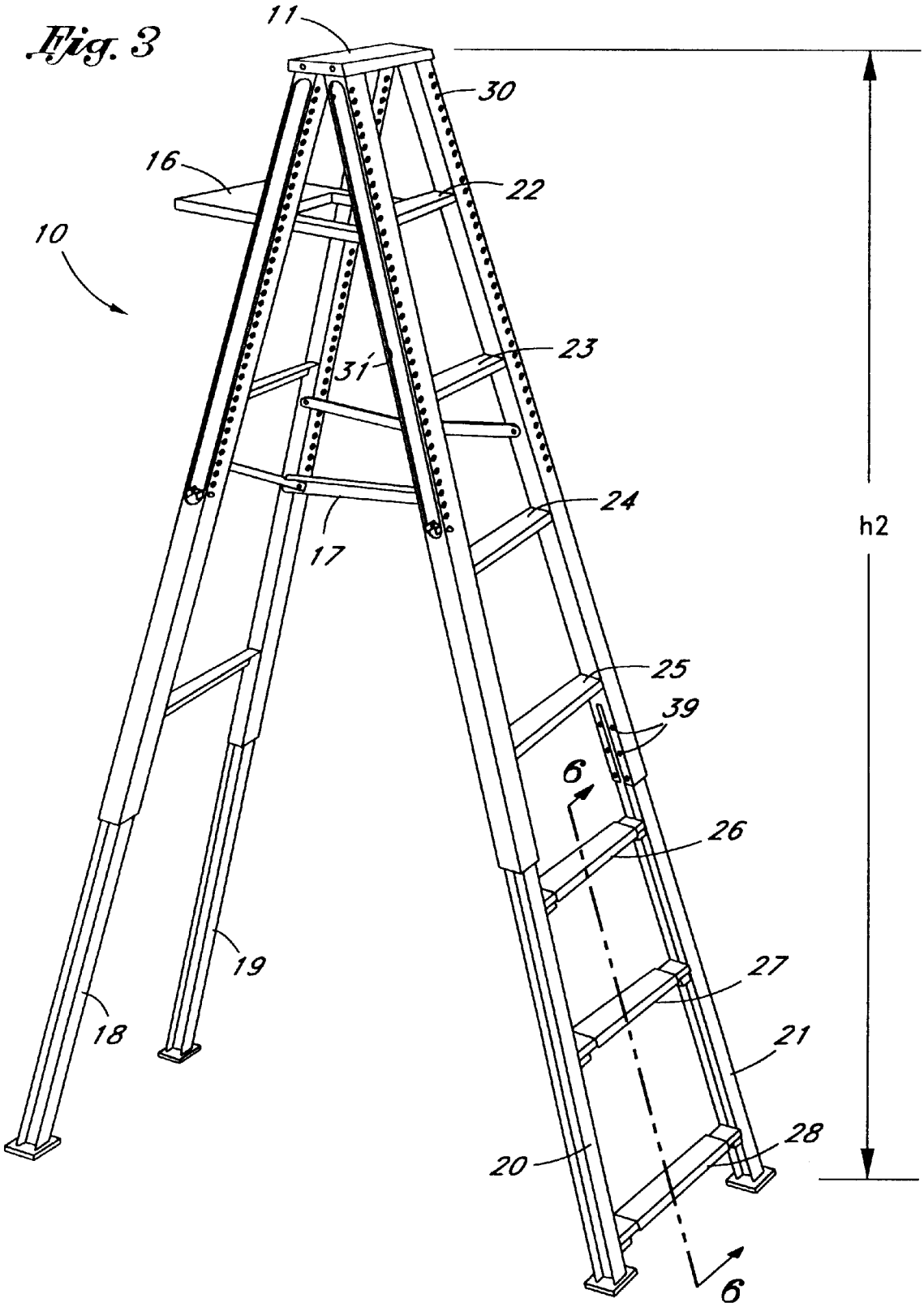
FIG. 3 is a perspective view of the adjustable step ladder of FIG. 1 in a fully extended position.

The adjustable step ladder of the present invention is shown in perspective view in FIG. 1 and indicated by reference character 10. Ladder 10 has a head step 11 to which two weight supporting fixed side rails 12 and 13 are hingedly attached. Two step supporting fixed side rails 14 and 15 are also held by head step 11. A conventional pail rest 16 and spreader 17 complete the conventional portion of the adjustable step ladder of FIG. 1. Ladder 10 has four individually extending legs. Those affixed to the weight supporting fixed side rails are indicated by reference characters 18 and 19 and those affixed to the step supporting fixed side rails are indicated by reference characters 20 and 21. Ladder 10 has four fixed steps 22, 23, 24 and 25. Ladder also has three adjustable steps 26, 27 and 28. The individually extending legs are held in position by spring loaded pins 29 assembly which may be moved in and out of a plurality of holes 30 in the exterior surface of each of the fixed side rails. A pair of tabs 29' retract pins 29 and may be notched through slot 31'. In this way each individually extending leg can be individually positioned as desired. The particular method for fixedly adjusting the legs is not critical and numerous construction can be used.

Pins 29 are spring loaded in cylinder 31 held by the I-beam shaped extending legs. Preferably an adjustable shoe 32 is positioned at the base of each extending leg. This provides still further adjustment since the extending legs are moveable only between individual holes 30. Step ladder 10 is shown in its unextended configuration in FIG. 1 and the height of the ladder is indicated by reference character h1.

Figure 4:
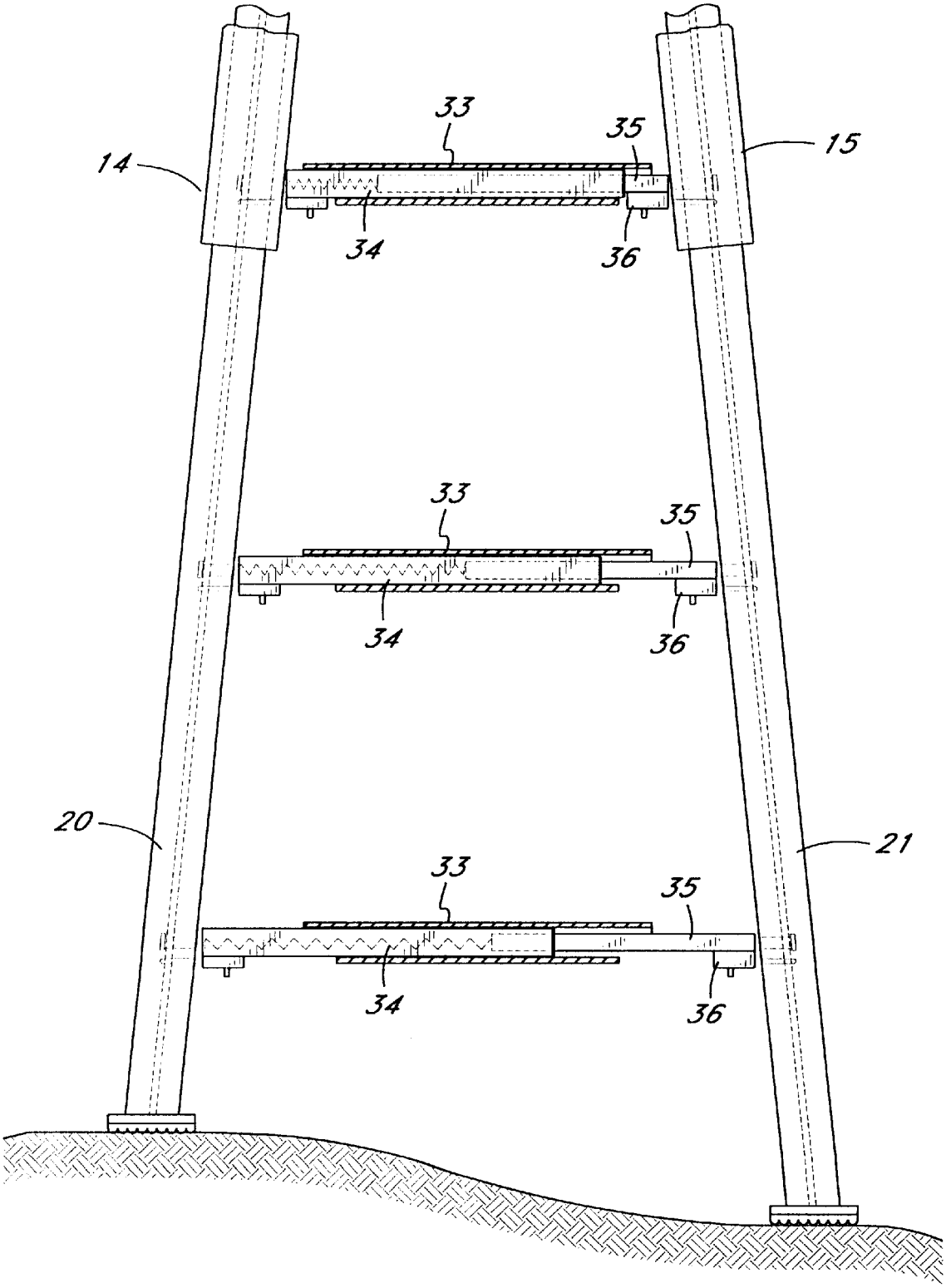
FIG. 4 is a front view of the adjustable legs of the step ladder of FIG. 3.
Figure 5:
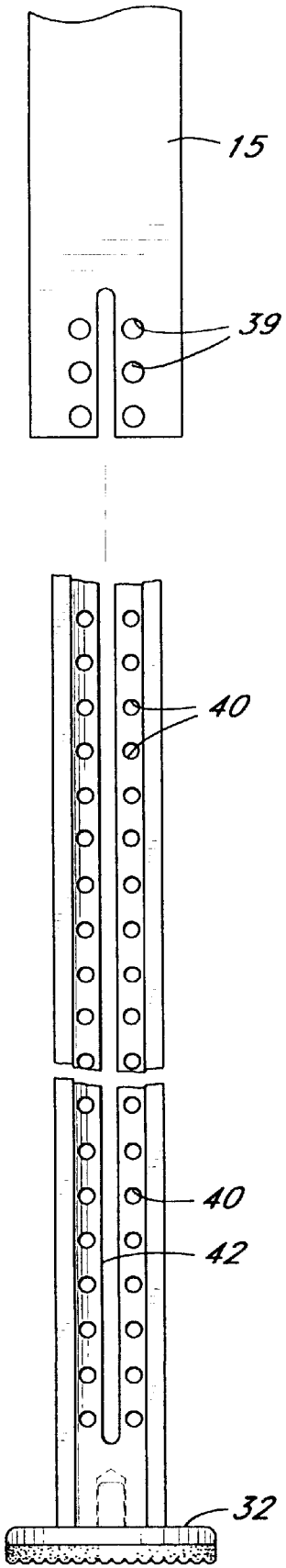
FIG. 5 is a side view showing the bottom of a step supporting fixed side rail leg and an individual extending leg therebelow.
Figure 6:
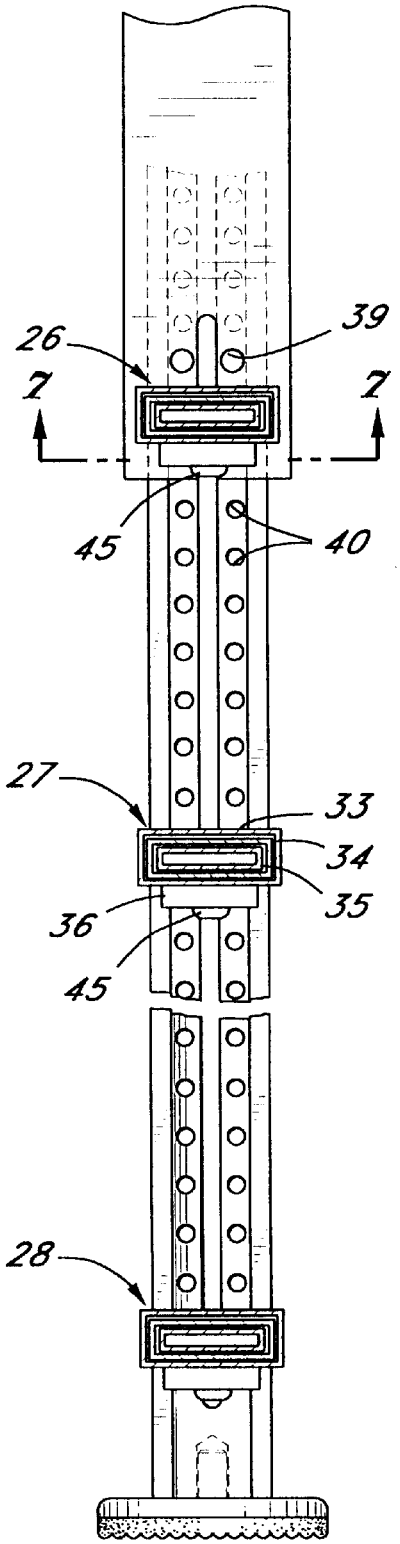
FIG. 6 is a cross-sectional view taken along line 6—6 of FIG. 3.
Figure 7:
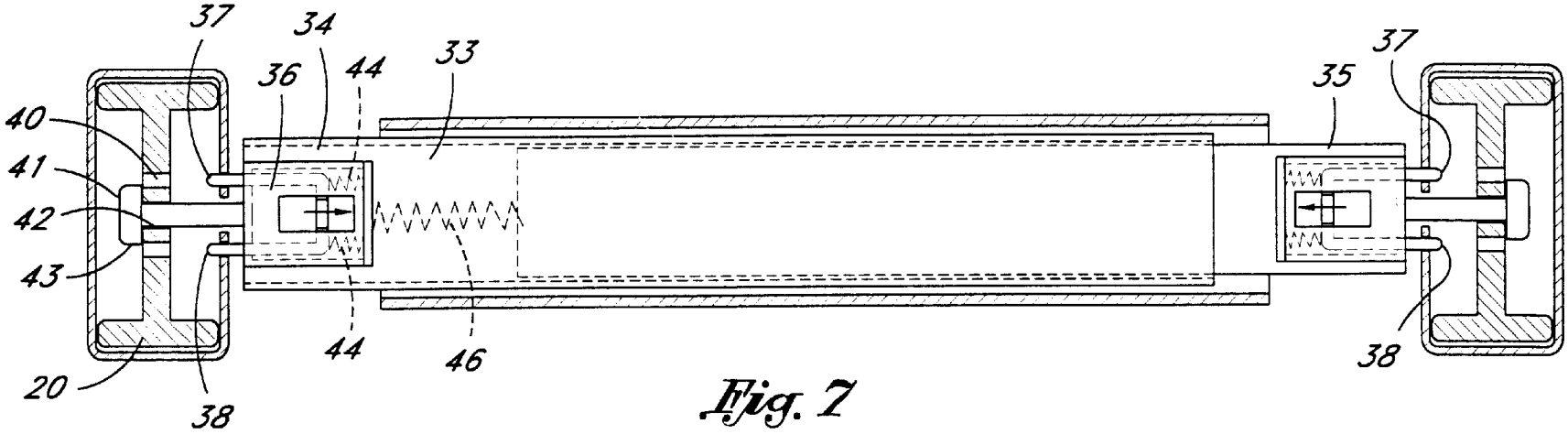
FIG. 7 is a cross-sectional view taken along line 7—7 of FIG. 6.
Figure 8:
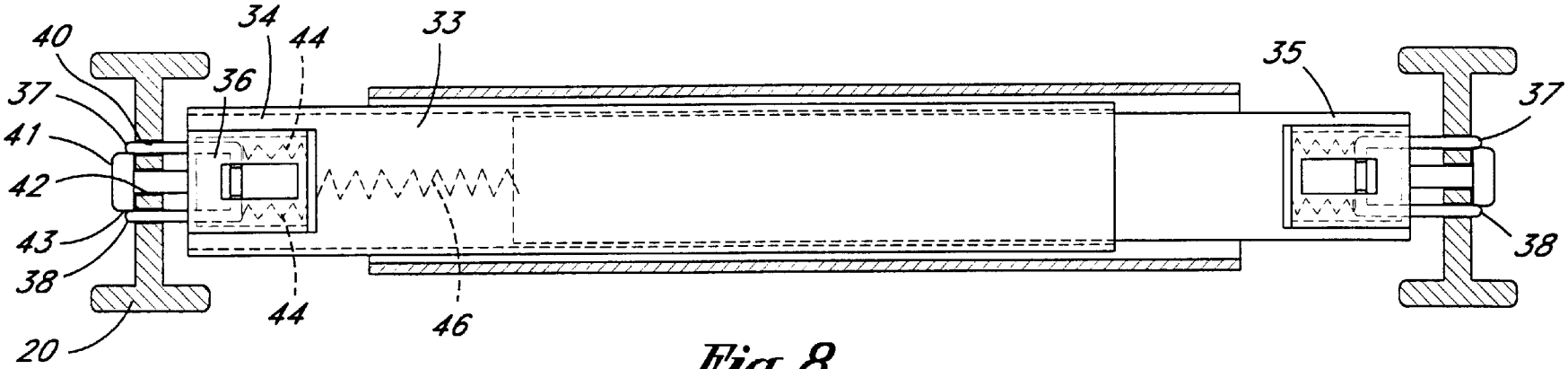
FIG. 8 is a cross-sectional view similar to FIG. 7 except with the step below the step supporting fixed side rail

In FIG. 3 the ladder is shown in its fully extended configuration and the height is indicated by reference character h2. It is also noted that extending leg 21 is positioned at a longer length than extending leg 20. Likewise extending leg 19 is shown at a shorter length than extending leg 18. This, of course, is accomplished merely by retracting pins 29 and pulling the ladder down until a desired position and then permitting the pin to pop out of a pair of holes 30. An essential feature of the present invention is the adjustable and telescoping steps 26, 27 and 28. These are shown partially cut away in FIG. 4 where it can be seen that each leg has an outer rectangular piece 33 which is telescopingly held over an intermediate rectangular piece 34. This in turn is telescoped over an innermost rectangular piece 35. Pieces 34 and 35 have a pin supporting member 36 which supports a pair of pins shown in top view in FIG. 7 and indicated by reference characters 37 and 38. These may be either supported in holes 39 at the base of step supporting fixed side rails 14 and 15, or in holes 40 in individually extending legs 20 and 21. A center pin 41 extends through a slot 42 in individually extending legs 20 and 21. Pin 41 has an enlarged head 43 which pulls intermediate and innermost pieces 34 and 35 outwardly as the steps are lowered. Pins 37 and 38 are urged outwardly by spring 44 and are retracted by pulling tab 45 inwardly. Spring 46 pulls innermost rectangular piece 35 and intermediate piece 34 together.

The result is a ladder which is exceptionally stable because it is wider at its base and which may be set up to provide a very safe environment and easily adjusted to the individual terrain upon which the ladder is placed.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An adjustable step ladder of the type having a top, bottom, a head step, four fixed side rails affixed to the head step, two of which are step supporting rails comprising a right step supporting rail and a left step supporting rail and the other two of which are weight supporting rails, a plurality of fixed steps between two of the step supporting fixed side rails, all four of said fixed side rails being straight and angled evenly outwardly toward the bottom and, thus, being further separated from each other at the bottom than at the top, wherein the improvement comprises:

each of said fixed side rails having an independently extending leg adjustably held thereto comprising right and left independently extending legs, affixed to said weight supporting rails, a right extending step supporting leg affixed to said left step supporting rail, and a left extending step supporting leg affixed to said left step supporting rail; and at least one adjustable step having a right side and a left side, said adjustable step having length telescoping means, and said adjustable step being attached at its right side to said right extending step supporting leg and at its left side to said left extending step supporting leg of said step supporting rails, and said at least one adjustable step including means to move at least one side of said at least one adjustable step to a different vertical position along said one of said right and left extending step supporting legs so that the adjustable step remains substantially horizontal as one of said right and left extending step supporting legs is moved to a different vertical length than the other of said right and left extending step supporting legs.

2. The adjustable step ladder of claim 1 wherein there are a plurality of adjustable steps.

3. The adjustable step ladder of claim 2 wherein said adjustable steps are removably affixable to said step supporting rails and also removably affixable to said individually extending legs.

4. The adjustable step ladder of claim 1 wherein said adjustable step has an innermost rectangular piece with a pair of pins extending outwardly therefrom, and intermediate rectangular piece telescoped over the innermost rectangular piece also having a pair of pins extending outwardly therefrom and an outermost rectangular step piece surrounding the intermediate rectangular piece and the innermost rectangular piece and said pair of pins on the innermost rectangular piece fit into a selected pair of holes on the individually extending legs of the step supporting side rails.

5. The adjustable step ladder of claim 4 wherein said independently extending legs extending from the step supporting side rails have a longitudinal slot and the innermost rectangular piece and the intermediate rectangular piece each have a central rod extending through the longitudinal slot with a head at the ends thereof to adjustably telescope the adjustable step.

6. The adjustable step ladder of claim 5 wherein the adjustable step may be affixed either to the step supporting fixed side rails or to the independently extending legs.

7. The adjustable step ladder of claim 6 wherein there are three adjustable steps.

8. The adjustable step ladder of claim 1 further including adjustable shoes at the base of each independently extending leg.

* * * * *